US005285427A

United States Patent [19]

Vaucher

[11] Patent Number: 5,285,427

[45] Date of Patent: Feb. 8, 1994

[54] TIMEPIECE IN WHICH THE HOURS DISPLAY MAY BE INDEPENDENTLY MODIFIED, IN PARTICULAR WHEN PASSING TO ANOTHER TIME ZONE

[75] Inventor: Frank Vaucher, Cormoret, Switzerland

[73] Assignee: Compagnie des Montres Longines, St. Imier, Switzerland

[21] Appl. No.: 65,796

[22] Filed: May 21, 1993

[30] Foreign Application Priority Data

May 21, 1992 [CH] Switzerland ..... 01 646/92-8

[51] Int. Cl.[5] ..... G04B 19/22; G04B 18/00

[52] U.S. Cl. ..... 368/21; 368/27; 368/185

[58] Field of Search ..... 368/21, 27, 76, 80, 368/185, 190–195

[56] References Cited

U.S. PATENT DOCUMENTS

| | | | |
|---|---|---|---|
| 3,358,437 | 12/1967 | Burg | 368/27 |
| 3,675,411 | 7/1972 | Sakuma | 368/27 |
| 4,634,287 | 1/1987 | Vuilleumier et al. | 368/27 |

FOREIGN PATENT DOCUMENTS

| | | |
|---|---|---|
| 0147757 | 12/1984 | European Pat. Off. . |
| 907360 | 3/1946 | France . |
| 2307301 | 11/1976 | France . |
| 2617993 | 1/1989 | France . |
| 340191 | 9/1959 | Switzerland . |
| 388855 | 6/1965 | Switzerland . |
| 584925 | 2/1977 | Switzerland . |

*Primary Examiner*—Vit W. Miska

*Attorney, Agent, or Firm*—Weil, Gotshal & Manges

[57] ABSTRACT

A timepiece including: an inner hours pipe (2) supporting a lower wheel (6), an outer pipe (30) mounted on the inner pipe (2) and supporting an upper wheel (32) arranged above the lower wheel (6), a star (12) mounted on the hours pipe (2) and fixed in rotation to the lower wheel (6), two driving rollers (20) cooperating with the star (12) and driven by the upper wheel (32) and a spring (26) bringing back the roller (20), such timepiece being characterized in that the lower wheel (6), which constitutes an hours wheel in mesh with a dial train, is mounted to be free in rotation relative to the inner hours pipe (2), while the upper wheel (32) forms a correction wheel capable of acting on the hours pipe (2) in order to modify the hour displayed.

8 Claims, 3 Drawing Sheets

TIMEPIECE IN WHICH THE HOURS DISPLAY MAY BE INDEPENDENTLY MODIFIED, IN PARTICULAR WHEN PASSING TO ANOTHER TIME ZONE

The present invention concerns a timepiece the hours display of which can be modified in an independent manner, that is to say, with no effect on the other time indications which are normally kinetically coupled to the hours indication, in particular the minutes and the seconds.

BACKGROUND OF THE INVENTION

There is already known, for example according to document CH 560 410, a timepiece of the type mentioned above, comprising an hours wheel coupled to the dial train, and a first pipe designated hours pipe bearing in a standard manner an indicating hand. Between such wheel and such pipe is interposed a coupling arrangement which furnishes a clutching/declutching function, while assuring indexing of the indicating hand in the angular positions corresponding to integer fractions of hours.

To this end, the hours pipe includes on the one hand a correction wheel which is controlled by a correction mechanism driven by the stem and, on the other hand, a star, the outer teeth of which cooperate with a driving roller.

Such roller includes a stud engaged in a radial slot formed in the plate of the hours wheel which is borne by a second pipe mounted to rotate on the hours pipe. Such driving roller is additionally maintained within the teeth of the star through a spring wire fixedly maintained on such wheel.

The roller may thus be driven in rotation by the hours wheel and it can, in normal operation thanks to its cooperation with the teeth of the star, drive the hours pipe which assures clutching between such pipe and said hours wheel.

During passage from one time zone to another, the user acts on the correction wheel thanks to the time setting stem which is then urged into a special position and it may thus effect direct rotation of the hours hand in acting on its pipe. This movement has no influence on the position of the hours wheel since rotation of the star provokes a skipping movement of the rollers by radial displacement of the latter at the exterior of the teeth of the star which assures declutching between the hours pipe and the hours wheel.

Next, the elastic return of the roller into the teeth of the star under action of the spring permits indexing of the hours wheel into a position corresponding to an integer fraction of an hour relative to the preceding position.

In this structure, the hours wheel is formed by the highest wheel or upper wheel (in the use position of the timepiece), while the correction wheel is formed by the lowest wheel which forms thus a lower wheel relative to the preceding.

These functions cannot be inverted. Effectively, should one wish that the lower wheel be the one which forms the hours wheel and the upper wheel, that which forms the correction wheel in order to guard standard gearing plans with the dial train, it is necessary then in such structure that the indicating hand be borne by the second pipe, that is to say, by the outer pipe. This solution necessitates providing a special fitting of the hands and does not permit use of an original hands fitting. This structure from the prior art may thus not be easily adapted to a standard movement.

This is why, in such structure, the hours wheel, in order to be able to mesh with the dial train pinion, includes a relatively thick toothing which necessitates special machining. Additionally, the plate face of the hours wheel must be shaped in order to assure anchoring of the spring which further requires a fitting operation. Thus, this timepiece is costly to make.

Furthermore, there is known from document CH 577 700 a timepiece also permitting an independent correction of the hours wheel, but in which the driving roller cooperates with the interior teeth of a wheel which pivots on a single pipe. Such wheel because of the interior toothing is thus also costly to form and its centering is not effected on a bearing of length sufficient to be reliable.

The present invention thus has as purpose to provide a timepiece of the type mentioned hereinabove which is inexpensive while being capable of adaptation to any type of movement without modifying, the original hand fitting and with a meshing of the lower wheel with the dial train.

SUMMARY OF THE INVENTION

To this effect, the invention has as object a timepiece including:

- a first pipe, designated inner pipe, constituting the hours pipe and supporting a first outwardly toothed wheel, designated lower wheel,
- a second pipe designated outer pipe, mounted on the first and supporting a second outwardly toothed wheel, designated upper wheel, arranged above the lower wheel,
- a star exhibiting outer teeth and which is mounted on the hours pipe being fixed in rotation to the lower wheel supported by such pipe,
- at least one driving roller cooperating with the teeth of the star and engaged in at least one radial slot formed in the upper wheel, and
- elastic means formed so as to maintain and return the roller within the teeth of the star,
- one of the two wheels constituting an hours wheel in mesh with a dial train while the other wheel forms a correction wheel capable of acting on the hours pipe so as to modify the hour displayed, characterized in that the lower wheel is mounted to be free in rotation relative to the inner hours pipe and constitutes said hours wheel while the upper wheel forms said correction wheel.

According to another characteristic of the invention, the hours wheel is mounted to be free in rotation through the driving star which is guided in rotation on the hours pipe.

It will also be specified, that the star is maintained axially between the two pipes which are fixedly mounted relative to one another.

According to another characteristic, the outer pipe is force mounted by driving onto the inner hours pipe.

Other characteristics and advantages of the invention will appear upon reading the detailed description which follows, made having reference to the attached drawings which are given solely by way of example.

DESCRIPTION OF THE PREFERRED EMBODIMENT

Figure 1:
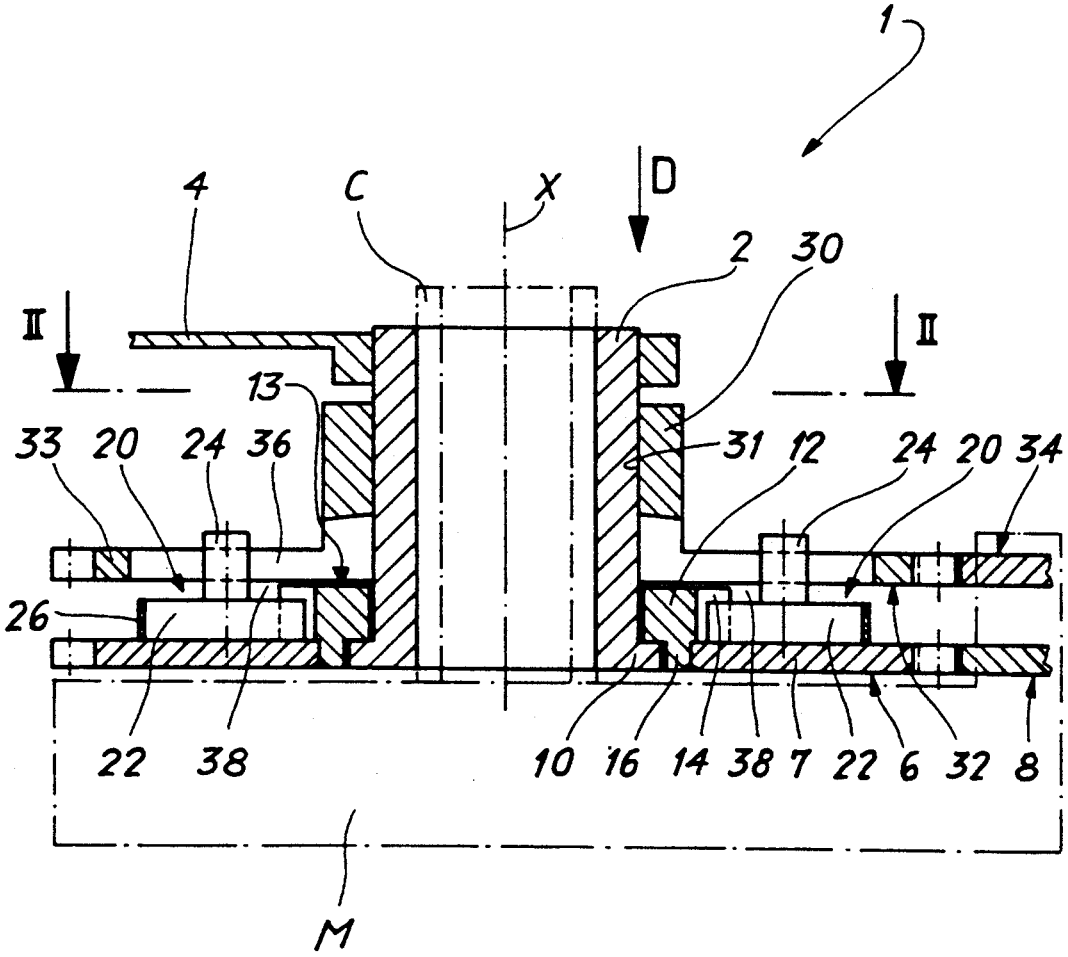
FIG. 1 is a longitudinal cross-section of the timepiece according to the invention, taken along arrow line I—I of FIG. II.

Referring initially to FIG. 1, there will be described hereinafter the timepiece according to the invention, which is designated by the general reference 1 and from which are shown here only elements forming the object of the present invention.

The timepiece according to the invention includes a first pipe 2, designated inner pipe, intended to be mounted in a standard manner for rotation around a rotation axis X, on a cannon pinion C, driven by a standard timepiece movement M, both shown in a schematic fashion by broken outlines on FIG. 1. The inner pipe 2 bears an indicating hand 4 forming the hours hand, which hand is driven exteriorly onto the free end of pipe 2 projecting from timepiece 1.

The inner pipe 2 thus forms an hours pipe and it supports a first outwardly toothed wheel 6 designated lower wheel including a plate 7. It will be specified here that in an advantageous manner such lower wheel 6 forms an hours wheel and it meshes with a wheel of the dial train 8 (partially shown) forming part of a standard dial train of movement M. In normal operation, such hours wheel 6 receives time information furnished by the dial train wheel 8, which information it transmits as will be understood hereinafter, indirectly to the inner hours pipe 2 and to the indicating hand 4.

Effectively, the lower hours wheel 6 is mounted free in rotation on the hours pipe 2. For this, the hours pipe 2 includes, at the end opposite its free end bearing hand 4, a collar 10 forming a shoulder freely supporting a star 12 on which is fixedly maintained wheel 6. Star 12 includes a plate 13, outer teeth 14 and a circular flange 16 formed on edge under plate 13 in a manner adjacent to teeth 14 behind and coaxial to the latter.

The hours wheel 6 is fixedly maintained on star 12 on the side against its teeth 14. In effect, the hours wheel 6 through the central part of its plate 7 which exhibits an open bore, is exteriorly force fitted on the flange 16 by driving and/or riveting Star 12 and the hours wheel 6 are thus directly fixed together in rotation and, in this example they form, thanks to their assembly, but a single piece mounted on the hours pipe 2.

Star 12 and the hours wheel 6 can thus be displaced together in a concomitant manner under the effect of the dial train wheel 8.

The timepiece according to the invention further includes two driving rollers 20 which are stepped and each of which exhibits a cylindrical seat 22 from which extends normal thereto a stud 24. The rollers are both engaged at rest by their seat 22 in the teeth 14 of star 12 and they rest freely and laterally by such seat against the face, not referenced, of plate 7 of the hours wheel 6. Such rest position is likewise shown in a top view on FIG. 2.

Rollers 20 are further elastically maintained in such rest position in teeth 14 by elastic return means 26 which here are formed by an annular closed spring mounted coaxially to star 12 and acting radially on the outer periphery of the seats 22 of rollers 20. It will here be noted that spring 26 is freely mounted against the driving rollers 20 with no fixed attachment onto timepiece 1. Spring 26 further rests freely against and more specifically on plate face 7 of the hours wheel 6. Spring 26 is thus self-supporting and self-centered.

The timepiece according to the invention further includes a second pipe 30 designated outer pipe which includes a guiding bore 31 and which is exteriorly mounted by such bore 31 on the first pipe 2. Such second pipe 30 supports a second outwardly toothed wheel 32 arranged above the lower hours wheel 6 and designated upper wheel. Here it will be specified that the positions upper and lower of wheels 6 and 32 are taken with reference to the drawing of FIG. 1 which shows the timepiece according to the invention in its position of use by the wearer, that is to say, with the hands oriented towards the top.

The upper wheel 32 includes a plate 33 and by its outer teeth it meshes with a wheel 34 of a correction mechanism of the movement M, such wheel 34 being adapted to be driven in a standard manner by the stem, not shown.

The upper wheel 32 thus forms a correction wheel permitting, as will be understood, to correct directly the position of the hours pipe 2 and of the indicating hand 4 without acting on the dial train and thus without disturbing the other time information, such as the minutes and the seconds, which are normally kinematically coupled to the hours pipe 2 via said dial train.

In an advantageous manner, outer pipe 30 is force mounted by driving it over the outside of the inner hours pipe 2 and it is thus fixed to the latter.

These two pipes are thus fixed in rotation and they may be displaced together in a concomitant manner.

The upper correction wheel 34 thus acts on the inner hours pipe 2 through the outer pipe 30.

It will be specified that the hours pipe 2 is further driven in normal operation by the dial train of movement M and in particular by wheel 8 of the dial train, also thanks to the outer pipe 30.

This is why in plate 33 of the correction wheel 32 radial slots 36 are provided in which are freely engaged the studs 24 which may be radially translated in the latter.

The rollers 20 may thus drive in rotation the correction wheel 32 and the two pipes 2 and 30 when star 12 is itself driven by hours wheel 6.

It will be noted that the radial slots 36 extend from the outer teeth of the correction wheel 32 to the body of the outer pipe 30 and open out interiorly in the latter, more specifically into its bore 31.

Slots 36 may thus be formed at the same time with the help of a form milling cutter, not shown, which is immerged in the plate 33 of wheel 32 and into pipe 30.

It will also be noted that star 12 is axially maintained between the outer pipe 30 and collar 10 of the hours pipe 2. These two pipes which are driven into one another form thus a channel 38 permitting the guidance in rotation and the axial maintenance of the mounted assembly constituted by star 12 and the hours wheel 6.

It is understood that the structure which has just been described forms a declutchable coupling mechanism interposed between the hours wheel 6 and the inner hours pipe 2 in order to permit a stepwise correction of the hours display according to the indexed positions corresponding to an integer fraction of the number of hours.

Figure 2:
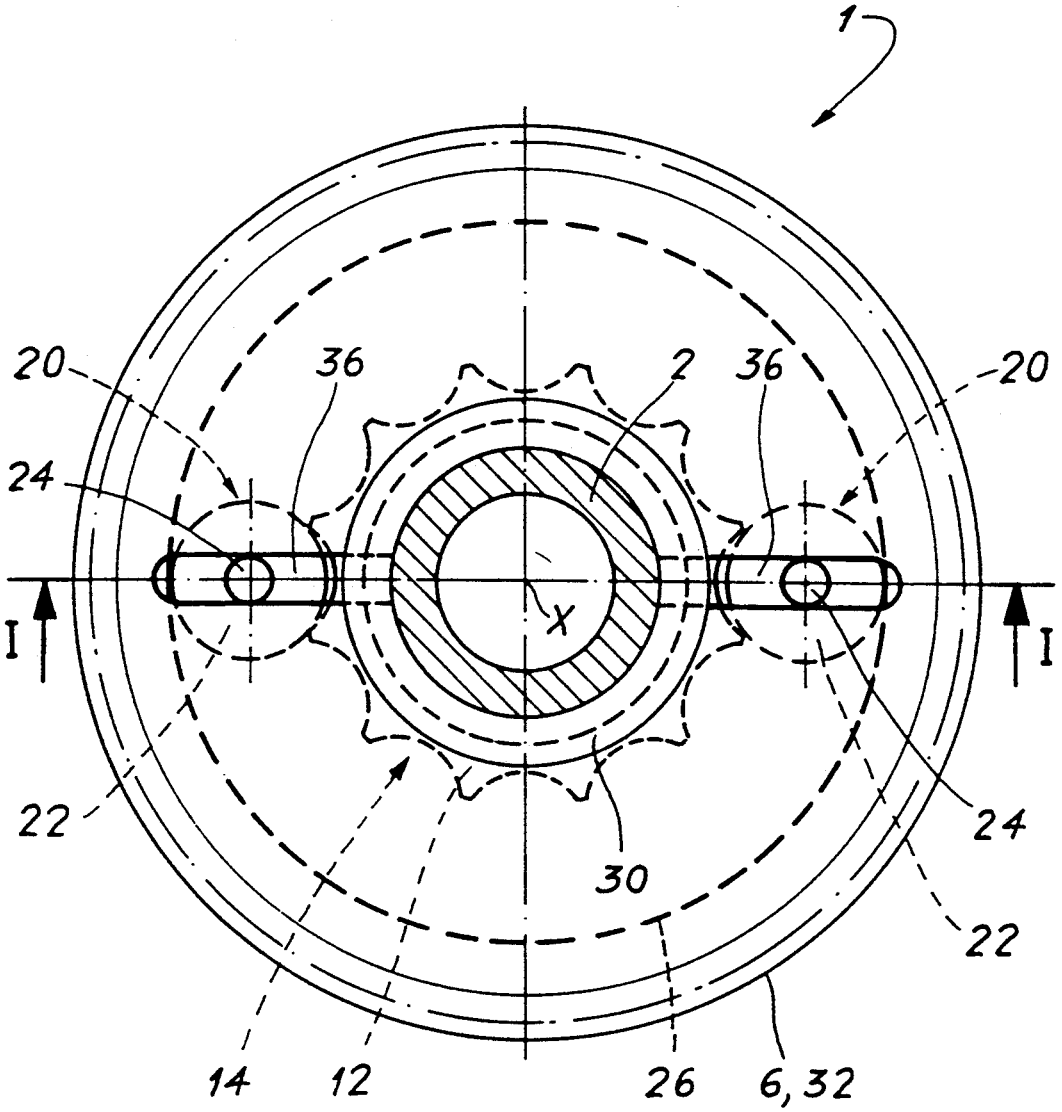
FIG. 2 is a top view showing partially in cross-section and in a first position the timepiece of FIG. 1 according to line II—II of such figure.

The timepiece is shown on FIG. 2 (without elements C, M, 8 and 34) in a position displaying the hour corresponding to one of the time zones.

Figure 3:
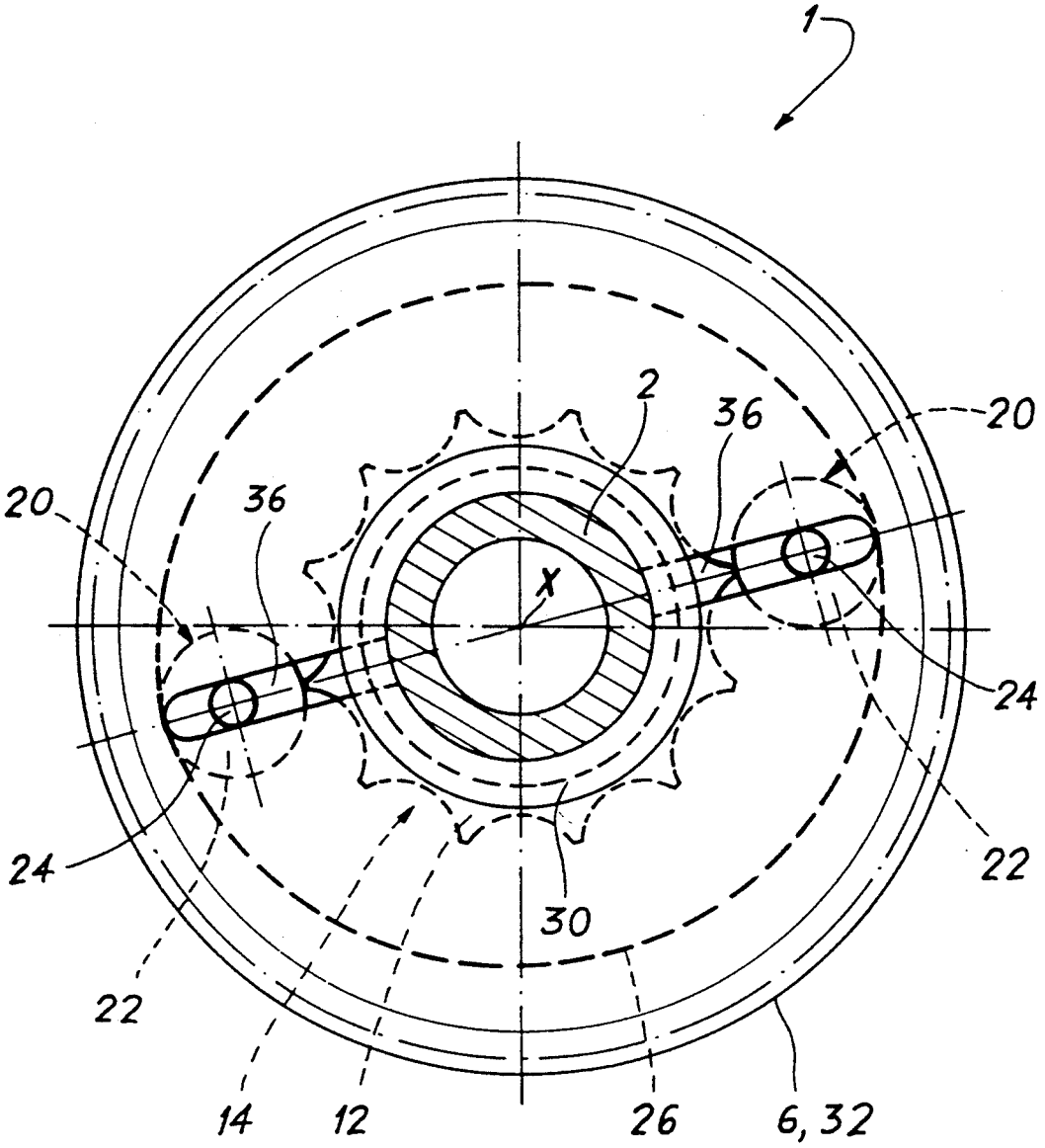
FIG. 3 is a view similar to FIG. 2, but showing the timepiece according to the invention in a second position during passage to another time zone.

FIG. 3 shows the piece according to the invention in an intermediate position during passage onto another time zone. It will thus be noted that during the putting into rotation of the correction wheel 34, rollers 30 are angularly displaced and (when the star 12 and the hours wheel 7 remain fixed) skip over the teeth 14 of star 12 forcing spring 26 into an oval form. The rollers 20 then return into teeth 14 of star 12 in rest position, but in a shifted manner relative to the position of FIG. 2. Hand 4 then indicates another time zone. It will be specified that although the toothing of star 12 includes 12 teeth on the figures (in order to indicate the 12 hours), such toothing could bear 24 thereof for application to a timepiece of the 24 hour type.

It will also be noted that this structure of which the hours wheel 6 and the hours pipe 2 make up a part, forms a unit which may be easily removed from the timepiece and which may be easily transportable without risk of untimely disassembly of its components.

Effectively, rollers 20 are maintained confined between the correction wheel 32 and the hours wheel 6 which itself is maintained by the two pipes 2 and 30.

Rollers 20 are further maintained radially in place by spring 26 which is also confined between the two respective upper and lower wheels.

Disassembly of such unitary structure may be brought about simply in bearing on the face at the end of flange 16 and in disengaging the inner pipe 2 by acting along arrow D on the end face projecting from the side of the hands.

In this case, rollers 20 remain supported by the plate 7 of the correction wheel 6 and the hours pipe 2 may be replaced without the necessity of taking apart the other components.

What I claim is:

1. A timepiece including:

a first pipe, designated inner pipe, constituting the hours pipe and supporting a first outwardly toothed wheel, designated lower wheel, a second pipe designated outer pipe, mounted on the first and supporting a second outwardly toothed wheel, designated upper wheel, arranged above the lower wheel, a star exhibiting outer teeth and which is mounted on the hours pipe being fixed in rotation to the lower wheel supported by such pipe, at least one driving roller cooperating with the teeth of the star and engaged in at least one radial slot formed in the upper wheel, and elastic means formed so as to maintain and return the roller within the teeth of the star, one of the two wheels constituting an hours wheel in mesh with a dial train while the other wheel forms a correction wheel capable of acting on the hours pipe so as to modify the hour displayed, the lower wheel being mounted to be free in rotation relative to the inner hours pipe and constituting said hours wheel while the upper wheel forms said correction wheel.

2. A timepiece as set forth in claim 1, wherein the hours wheel is mounted to be free in rotation through the driving star which is guided in rotation by the hours pipe.

3. A timepiece as set forth in claim 1, wherein the star is axially maintained between the two pipes which are fixedly mounted relative to one another.

4. A timepiece as set forth in claim 3, wherein the outer pipe is force mounted by driving it onto the inner hours pipe.

5. A timepiece as set forth in claim 1, including at least one second driving roller mounted in a second slot formed in the upper wheel.

6. A timepiece as set forth in claim 1 or in claim 5, wherein said elastic means are constituted by a closed annular spring which is freely mounted against the driving rollers.

7. A timepiece as set forth in claim 6, wherein said spring rests freely on the plate face of the lower wheel.

8. A timepiece as set forth in claim 5, wherein said slots extend from the outer teeth of the upper wheel and open out within the outer pipe.

* * * * *